US009857744B2

(12) United States Patent
Parsons et al.

(10) Patent No.: US 9,857,744 B2
(45) Date of Patent: Jan. 2, 2018

(54) METHOD FOR INCREASING THE CAPACITY OF HIGH CAPACITY FEEDER TRAYS FOR UNEVEN STOCK

(71) Applicant: XEROX CORPORATION, Norwalk, CT (US)

(72) Inventors: John P Parsons, Torrance, CA (US); James M Maryniak, Webster, NY (US); John M Palmer, Webster, NY (US); John D Ormonde, Artesia, CA (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/083,338

(22) Filed: Mar. 29, 2016

(65) Prior Publication Data

US 2017/0285544 A1 Oct. 5, 2017

(51) Int. Cl.

| | |
|---|---|
| ***G03G 15/00*** | (2006.01) |
| ***B65H 7/06*** | (2006.01) |
| ***B65H 7/20*** | (2006.01) |

(52) U.S. Cl.

CPC ..... *G03G 15/5029* (2013.01); *B65H 7/06* (2013.01); *B65H 7/20* (2013.01); *G03G 15/6529* (2013.01); *B65H 2301/1421* (2013.01); *B65H 2553/42* (2013.01); *B65H 2601/421* (2013.01)

(58) Field of Classification Search

CPC ..... G03G 15/5029

USPC ..... 399/393

See application file for complete search history.

(56) References Cited

U.S. PATENT DOCUMENTS

| | | | | |
|---|---|---|---|---|
| 5,364,087 | A | 11/1994 | Schieck et al. | |
| 5,993,367 | A * | 11/1999 | Hattori | G01N 21/88 156/378 |
| 6,305,281 | B1 * | 10/2001 | Aizawa | B41L 13/06 101/116 |
| 6,353,726 | B1 * | 3/2002 | Murata | B65H 7/00 399/18 |
| 7,889,362 | B2 * | 2/2011 | Tsukuba | G06K 15/021 358/1.12 |
| 7,980,553 | B2 * | 7/2011 | Haflinger | B65H 7/14 271/152 |
| 2003/0053834 | A1 * | 3/2003 | Suzuki | G03G 15/6514 399/392 |
| 2010/0025915 | A1 * | 2/2010 | Amano | B65H 43/00 271/9.02 |

* cited by examiner

*Primary Examiner* — Anthony Nguyen

(57) ABSTRACT

A method for feeding uneven media from a high capacity feeder includes rotating the pages in a stack 180° every 100-250 pages. This is only done with non-flat pages, such as, envelopes, pages with labels thereon, etc., which create tilted stacks and limit the number of pages that can be placed in the high capacity feeder. Rotating the pages 180° distributes the uneven build-up of the pages and creates a relatively flat stack, allowing the high capacity feeder to be filled to capacity. A camera or sensor placed in the high capacity feeder will detect the orientation of the stack on the fly so the image can be rotated accordingly.

19 Claims, 3 Drawing Sheets

METHOD FOR INCREASING THE CAPACITY OF HIGH CAPACITY FEEDER TRAYS FOR UNEVEN STOCK

BACKGROUND

1. Field of the Disclosure

This disclosure relates to machines that process stacked objects and output the processed items in a stack. For example, printing industry systems commonly stack blank recording mediums and feed them into printing processors and stack printed outputs. This type of stacking/processing/stacking sequence may also be found in common office equipment, such as, xerographic copiers or printers.

2. Description of Related Art

Feeding media that stacks unevenly presents a common challenge in reproduction devices. Common media types include stocks with cards attached to one end of the page (documents with insurance cards attached), stocks with labels on one side of the page, such as, shipping labels and envelopes where the flap creates an extra layer of paper. Typically, the maximum amount of this type of media is around 100 pages before the stack becomes to lopsided and pages miss-feed at the initial point of take up from the stack. This is particularly a problem in production environments where large capacity feeders remain largely unused and require frequent reloading.

An attempt at solving this problem is shown in U.S. Pat. No. 5,364,087 issued Nov. 15, 1994 to Richard A. Schieck, et al, entitled "Tilting Tray for Feeding and Stacking Specialized Forms which describes a modular insert for a print media sheet elevator tray for providing a substantially level top sheet surface for a variable height stack of multiple specialized forms having peelable labels in a marginal area thereof which causes these specialized sheets to have a greater thickness in that area than in the rest of the sheets. As may be seen from this patent, this is provided there by making approximately half of the stack bottom supporting surface 209 pivotable downward with the weight of the stack in that thicker area against the force of springs 212, 214, as described in Col. 8, for example. This disclosed counter-spring partial stack support pivoting system apparently assumes consistent correlation of stack height to stack end area weight downward force, minus sheet beam strength, versus spring upward force. Col. 8, lines 39-45 of this patent also incidentally mentions, but does not show, that: " . . . instead of using a spring mounted support for the thicker marginal region, a ratchet arrangement of a rack and pinion may be used wherein the support is moved down the requisite distance to insure that the leading and trailing marginal regions of the uppermost sheet of the stack of copy sheets are substantially level." However, even if the latter suggestion were enabled (which would seem to require some sort of additional controlled drive, not disclosed), all of the bottom-most sheets of the stack of sheets will still be variably significantly bent, as shown in this patent, because only one portion of the stack support tilts while the other portion remains fixed horizontally. In contrast, inter alia, the embodiment disclosed herein can desirably maintain most of the stacked special sheets substantially planar irrespective of the number of multiple sheets being stacked (the stack height) or the stack weight.

Other known tilting trays include a spring loaded hinged stacking tray for the output of stapled sets of printed sheets (sets that are thicker on their stapled side) that is hinged downstream to tilt down upstream (adjacent the sheet exit tray entrance area) to reduce uneven stack growth due to the staples or other set bindings. However, spring pivoting trays in general typically have a limited capacity of stacking height as compared to elevator stacking trays, as well as only an approximated appropriate amount or degree of pivoting, as noted above.

BRIEF SUMMARY

In answer to the above-mentioned shortcomings of previous attempts at feeding media that stacks unevenly, a method of feeding uneven media is disclosed that includes rotating the pages of media in a stack 180° every 100-250 pages. This is only done with non-flat pages (envelopes, DocuCards®, etc.) which create tilted stacks and limit the number of pages that can be placed in the feeder. Rotating the pages 180° distributes the uneven build-up and creates a relatively flat stack, allowing the feeder to be filled to capacity. A camera placed in the feeder will detect the orientation of the stack on the fly so the images can be rotated accordingly.

BRIEF DESCRIPTION OF THE DRAWINGS

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The terms "sheet" or "print media" herein interchangeably refer to a usually flimsy physical sheet of paper, plastic, or other suitable physical substrate for images.

Figure 1:
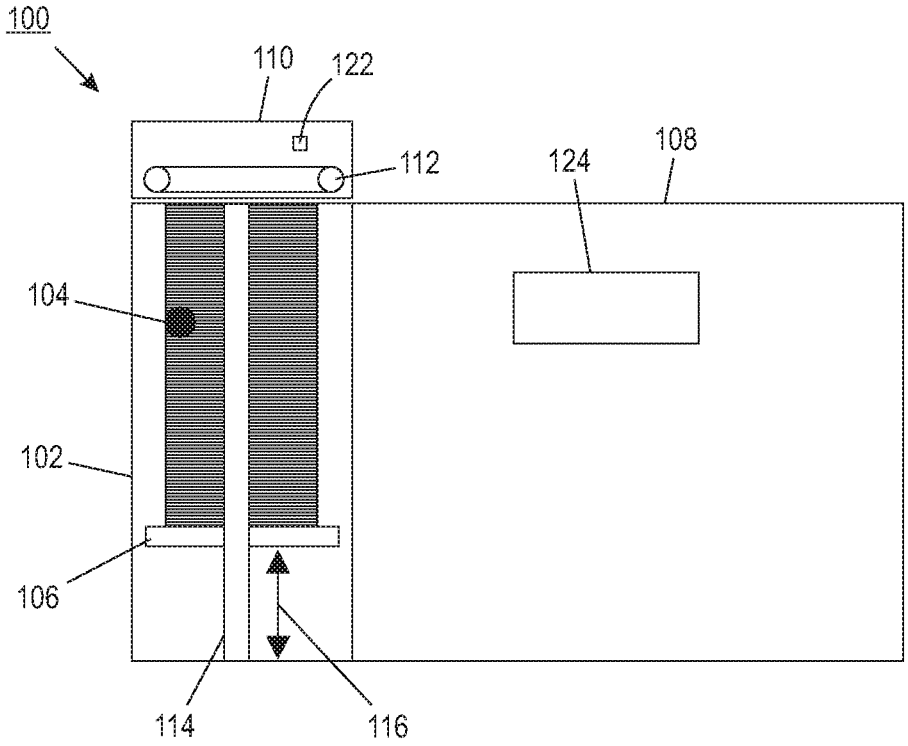

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Using the method of feeding discussed above, documents having non-uniform thicknesses such as DocuCards®, for example, may be stacked in a tray so that the uppermost recording medium may be maintained at a particular position for proper feeding of the recording medium into a processor such as a printer or to accept processed recording mediums into a stacker.

Figure 2:
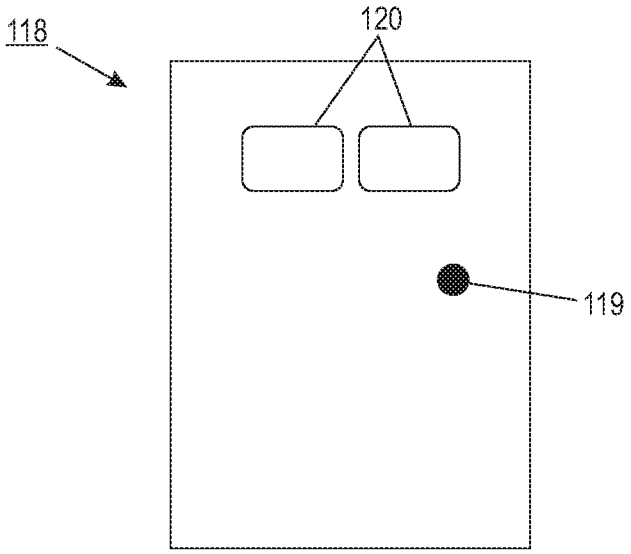
Figure 3:
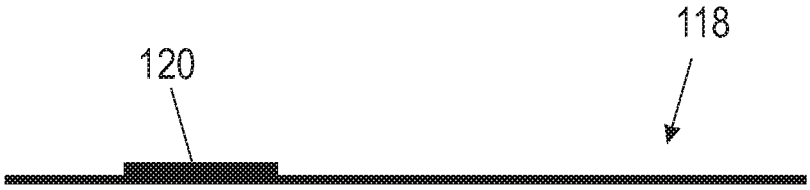
Figure 4:
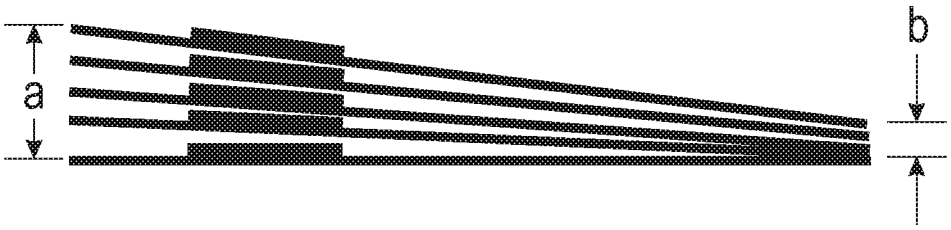

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

FIG. 1 shows an example of a feed tray coupled to a processing machine;

FIG. 2 shows an example of an object to be processed, such as a DocuCard®;

FIG. 3 shows an exemplary profile of the DocuCard® of FIG. 2;

FIG. 4 shows an exemplary stack of DocuCards®; and

Figure 5:
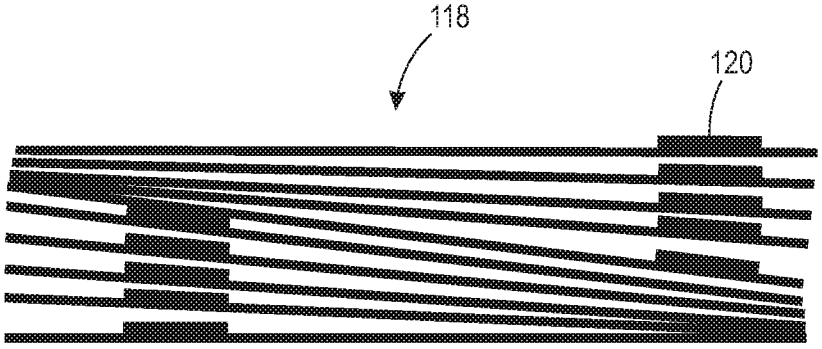

FIG. 5 shows an exemplary stack of DocuCards® stacked in accordance with the present disclosure.

As discussed above, many types of machines process objects that are stacked in an input tray, and each object of the stack may be input into the processing machine, processed and output to an output stacker. For ease of discussion, a print machine such as a xerographic copier or printer is used as an example to illustrate various features related to the input and output trays.

FIG. 1 shows an exemplary diagram of an office device such as a xerographic printer 100 that may include a feed tray 102, a feeder 110 and a print machine 108. The feed tray includes a tray lift 106 that may be guided by a lift guide 114. Recording medium 104 may be stacked above the tray lift and moved in a substantially linear movement directions 116.

Recording medium 104 may have substantially uniform thickness and tray lift 106 lifts the stack of recording mediums 104 upwards so that a belt assembly 112, for example, of feeder 110 may separate a top recording medium from the stack and feed the top recording medium into print machine 108 for processing.

Feed tray 102 shown in FIG. 1 may be efficient for recording mediums 104 that have substantially uniform thickness. However, if the thickness distribution of the recording medium is not substantially uniform, then the interaction between the top recording medium and belt assembly 112 may become complicated and may result in various difficulties such as misfeeds, etc. Although interface requirements between the top recording medium and belt assembly 112 may vary depending on different types of feeding mechanisms, it is usually a requirement that the top surface of the top recording medium is substantially parallel to (or flat relative to) a bottom surface of belt assembly 112 so that sufficient contact may be provided between belt assembly 112 and the top surface of the top recording medium to achieve the feeding process. In addition, a leading edge of the top recording medium usually must be aligned with an input port of the print machine 108 to achieve successful feeds. Thus, when recording medium 104 is thicker at one end than at other portions, the top surface of the top recording medium of a stack of such recording mediums may have one end that is substantially closer to belt assembly 112 than its remaining portion due to accumulated thicknesses of the complete stack of recording mediums.

DocuCard® is an example of such a document having non-uniform thicknesses across its surface. As shown in FIG. 2, a DocuCard® recording medium 118 may include cards 120 such as plastic credit cards mounted at particular positions on a substrate 119 such as paper, for example. When placed into a tray, DocuCard® 118 may be fed by belt assembly 112 into print machine 108.

FIG. 3 shows an exemplary profile of DocuCard® 118. Cards 120 have thicknesses that are comparable if not greater than the thickness of substrate 119. Thus, when stacked as shown in FIG. 4, the portion of DocuCards® 118 that include cards 120 may stack to a thickness "a" while portions that do not include cards 120 may stack to a thickness "b," and a>b. Thus, when DocuCards® 118 are placed into a feed tray such as feed tray 102, the stacking height on one side would be much greater than the stacking height on the other side. The top surface of the top DocuCard® would contact belt assembly 112 in a non-uniform way and the leading edge of the DocuCard® that feeds into print machine 108 would also be improperly aligned causing feeding errors, for example.

In accordance with the present disclosure, FIG. 5 shows a stack of uneven DocuCards® with the a predetermined number of DocuCards® rotated as a group or set 180° at predetermined intervals in order to present an approximately level stack at all times to the bottom surface of belt assembly 112. This approach allows a full tray of media with raised attachments or portions thereon to be loaded into high capacity feeders including oversize high capacity feeders while simultaneously maintaining a substantially level feeding surface to belt assembly 112. Belt assembly 112 includes a conventional trail edge thickness detection sensor 122 in FIG. 1 located in the take-up position for the feeder. DocuCards® 108 are generally fed trail edge first, but lead edges could be sensed, if desired. A signal from sensor 122 of a change in thickness in DocuCards® resulting from the DocuCards® being rotated will trigger the controller 124 of print machine 108 to automatically rotate the images from the now rotated documents by 180°. This will ensure that the proper orientation of the images is maintained on the print while simultaneously facilitating a much higher capacity use of feed tray 102 resulting in less frequent reloading of feed tray 102. Alternatively, rotation of sheet stacks 180° can be accomplished by providing sensor 122 as a camera over feed tray 102 that would identify when a page changes orientation by 180° and send a signal to controller 124 which in turn would signal an input output terminal of printer 108 to rotate the image accordingly.

In recapitulation, the embodiment of the present disclosure addresses a problem encountered when feeding uneven stock into a printer or other device and solves the problem by alternately stacking of the paper in a high capacity feeder. This is accomplished by rotating as a set every 100-150 pages 180°. Detection of each alternately stacked number of pages is by use of a paper thickness sensor or a camera strategically placed to monitor change in either the trail or lead edge of pages in the stack.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for feeding uneven media from a feed tray into a printing apparatus, comprising:

providing a feed tray;

providing a stack of uneven media in sets;

placing said sets of uneven media into said feed tray;

alternating said sets of media front to back within said feed tray;

providing a controller;

providing a sensor for sensing said alternate positioning of each of said sets of media within said feed tray; and rotating images of each set of media 180° within said printing apparatus each time said sensor sends a signal to said controller in response to sensed alternate positioning of each set of media.

2. The method of claim 1, wherein said sensor is a trail edge sensor.

3. The method of claim 1, wherein said sensor is a lead edge sensor.

4. The method of claim 1, wherein said sensor is a camera.

5. The method of claim 1, wherein said sets include between 100-250 pages.

6. The method of claim 5, wherein said sets include labels attached to one end of each page.

7. The method of claim 1, wherein said printing apparatus is a xerographic apparatus.

8. An electrostatographic printing machine adapted to feed uneven pages of media, comprising:

a feed tray;

a feeder for feeding pages of media from said feed tray;

a stack comprising sets of uneven media within said feed tray with each set of uneven media alternating front to back with each other in order to present an approximately level stack at all times to said feeder;

a sensor for sensing a change in thickness between each media set; and a controller adapted to receive signals from said sensor for each change in thickness of each set of said media and in response actuate said printing machine to rotate images 180° for each set of media sensed in response to said sensed signals.

9. The electrostatographic printing machine of claim 8, wherein each of said sets of media includes an attachment having a predetermined thickness.

10. The electrostatographic printing machine of claim 9, wherein said sensor is a trail edge sensor.

11. The electrostatographic printing machine of claim 8, wherein said sensor is a lead edge sensor.

12. The electrostatographic printing machine of claim 8, wherein said sensor comprises a camera.

13. The electrostatographic printing machine of claim 8, wherein said sets of a predetermined number of pages of media include between 100-250 pages.

14. A method for feeding non-flat pages from a feed tray into an imaging apparatus that places images onto said non-flat pages, comprising:

providing a stack of non-flat pages;

placing said non-flat pages into said feed tray and alternating said non-flat pages front to back within said feed tray every predetermined number of pages;

providing a feeder for feeding said non-flat pages into said imaging apparatus;

providing a controller;

providing a camera placed within said feeder, said camera being adapted to detect orientation of said non-flat pages within said stack on the fly and send a signal of such to said controller; and using said controller based upon said signal from said camera to rotate images 180° within said imaging apparatus in synchronism with said alternating of said stack of non-flat pages within said feed tray.

15. The method of claim 14, including providing said predetermined number of pages in sets of between 100-250 pages each.

16. The method of claim 14, wherein said predetermined number of pages includes materials attached to one end of each page.

17. The method of claim 14, including providing said imaging apparatus as a xerographic device.

18. The method of claim 14, wherein alternating said predetermined number of non-flat pages front to back within said feed tray distributes uneven build-up of said non-flat pages within said feed tray and creates a substantially flat stack while simultaneously allowing said feed tray to be filled to capacity.

19. The method of claim 14, wherein said sets of predetermined number of non-flat pages include materials attached to at least one end of each page.

* * * * *